US005664817A

United States Patent [19]

Ballew et al.

[11] Patent Number: 5,664,817

[45] Date of Patent: Sep. 9, 1997

[54] PORTABLE DOOR STOP

[75] Inventors: Chester N. Ballew, New Albany; Robert K. Eversole, Madison; Thomas C. Gaunt, Indianapolis, all of Ind.

[73] Assignee: E2 Enterprises Inc., Jeffersonville, Ind.

[21] Appl. No.: 547,526

[22] Filed: Oct. 24, 1995

Related U.S. Application Data

[63] Continuation-in-part of Ser. No. 366,896, Dec. 30, 1994, Pat. No. 5,542,725.

[51] Int. Cl.[6] ..... E05C 17/54

[52] U.S. Cl. ..... 292/339; 292/DIG. 15; 269/3; 269/170

[58] Field of Search ..... 292/288, 338, 292/339, DIG. 15; 269/316, 166, 167, 168, 169, 170

[56] References Cited

U.S. PATENT DOCUMENTS

| | | | |
|---|---|---|---|
| 985,028 | 2/1911 | Green | 269/170 X |
| 2,595,709 | 5/1952 | Sands | 292/DIG. 15 X |
| 2,774,622 | 12/1956 | Priebe | 292/339 X |
| 4,874,155 | 10/1989 | Goul | 269/6 |
| 5,265,854 | 11/1993 | Whiteford | 269/3 |
| 5,282,303 | 2/1994 | Schriever | 269/170 X |

*Primary Examiner*—Rodney M. Lindsey
*Attorney, Agent, or Firm*—Gary M. Gron

[57] ABSTRACT

A portable door stop comprising a pair of door engaging elements connected to one another by parallel links. A spring extends between the elements to draw them together against opposite faces of a door. A floor or ground engaging element is pivotally mounted to one of the elements so that when it is in place, movement of the door causes the elements to more tightly engage the door. The portable door stop may be used for doors which close in either direction.

11 Claims, 3 Drawing Sheets

PORTABLE DOOR STOP

This application is a Continuation-in-part of application Ser. No. 08/366,896 filed on Dec. 30, 1994 now U.S. Pat. No. 5,542,725 and entitled Portable Door Stop.

TECHNICAL FIELD

The present invention relates to door stops and more particularly to portable door stops.

BACKGROUND ART

Door stops, in one form or another, have been around since the invention of various means to bias hinged doors towards a closed position. Most commercially available door stops involve some form of a permanently mounted leg or arm which can be pivoted or displaced so that it makes frictional contact with the ground, floor, or an entry way stoop. Examples are found in U.S. Pat. Nos. 1,985,164, 2,217,996, and 3,831,989 which all show floor engaging elements which are permanently pivotally mounted to one side of a door. The problem with this type of door stop is that it is difficult to disconnect from one door and apply to another. In addition, according to some fire codes, permanent door stops are prohibited from being installed on a building exit door. This presents a particular problem for persons who make deliveries in commercial buildings where a door needs to be held in an open position until bulky objects such as furniture, appliances, or the like, pass through the door.

A number of proposals have been made in the art to provide removable door stops using the same principle of pivoted floor engaging members. Examples of this type of arrangement may be found in U.S. Pat. Nos. 2,709,615, 2,739,005 and 2,774,622. Aside from U.S. Pat. No. 2,774,622 the arrangements do not have an ability to accommodate doors of varying thickness. The design in U.S. Pat. No. 2,774,622 utilizes a clamping mechanism which is a difficult and cumbersome device to accommodate adjustable doors owing to the time it takes to thread the clamping mechanism in place.

DISCLOSURE OF THE INVENTION

The above and other problems are solved by the present invention in which a door stop is provided that has first and second elements incorporating opposed surfaces for abutting the opposite faces of a door. A means is provided for variably linking the first and second elements to abut opposite faces of different door thicknesses. A means is provided for yieldably biasing the first and second elements towards a minimum door thickness position so that the door engaging elements may be used on doors of different thicknesses. Finally, a floor engaging leg is mounted on one of the elements to prevent movement of the door on which the stop is positioned.

BEST MODE FOR CARRYING OUT THE INVENTION

Figure 1:
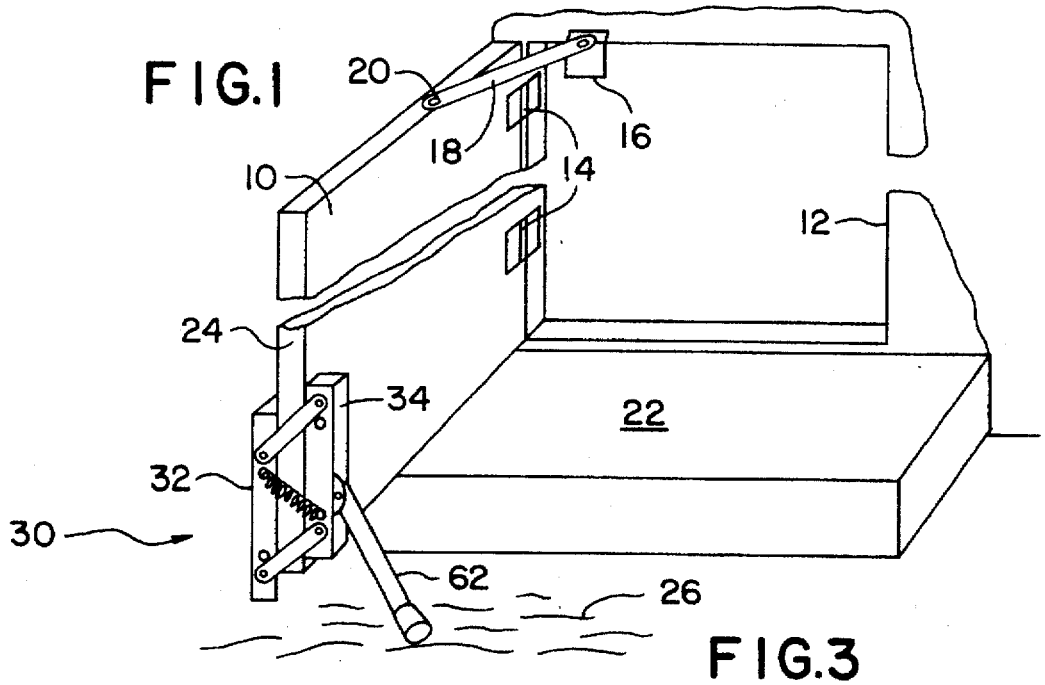
FIG. 1 is a perspective view of a portable door stop embodying the present invention in place on a door.

FIG. 1 shows a portable door stop of the present invention in place on a heavy duty commercial door 10 hinged to a doorway 12 by hinges 14. A commercial grade door closure component 16 has an arm 18 pivotally mounted to the door at 20 to bias the door to the closed position from the illustrated open position. In a typical arrangement the door 10 can open to the exterior side of a building and a stood or step 22 is immediately adjacent the door opening 12. However, the outer edge 24 of the door 10 swings well beyond the stood 22 so that it is some distance from the ground 26. A portable door stop 30 embodying the present invention, as will be described below, is able to accommodate the variable distance to the ground for commercial type doors, adequately resist the usual very strong closing forces by the door closure member 16, and can be quickly and easily installed on doors of variable thickness and opening both ways.

Figure 2:
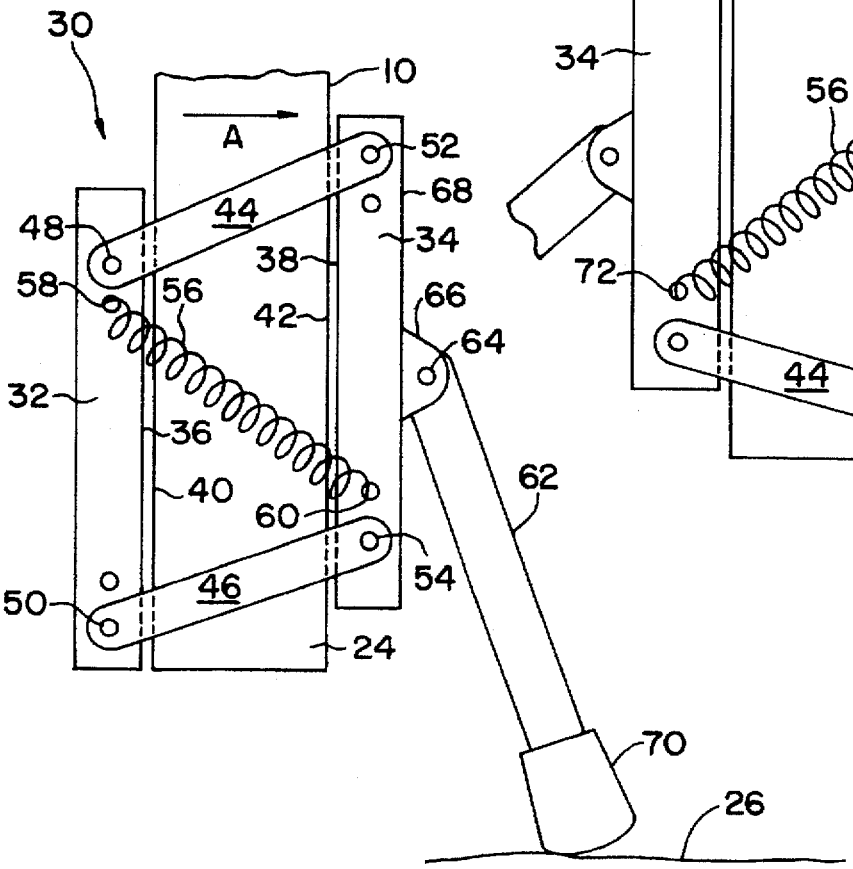
FIG. 2 is an end view of the door stop of FIG. 1 preventing door movement from left to right.
Figure 3:
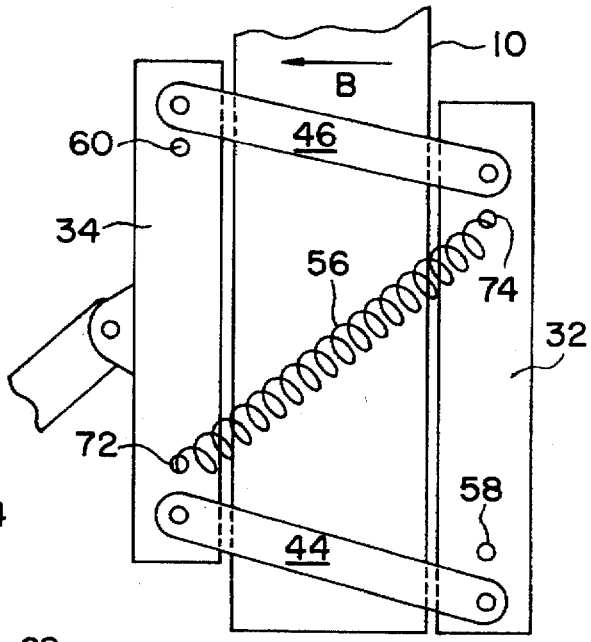
FIG. 3 is an end view of the door stop of FIG. 1 showing it in position to prevent door movement from right to left.

Referring to FIGS. 2 and 3, the portable door stop 30 comprises first and second elements 32 and 34 respectively, each having opposed abutment surfaces 36 and 38 respectively, which contact opposite faces of the door 10. Elements 32 and 34 may be made from any one of a number of appropriate materials. For the illustrated preferred embodiment, the elements 32 and 34 are fashioned from square cross section aluminum extrusions. Each of the elements 32 and 34 have friction surfaces 40 and 42 on the abutment surfaces 36 and 38, respectively. The friction surfaces 40 and 42 may be formed from appropriate friction material, for example, rubber. As shown, the friction material covers the entire surface. It should be apparent, however, that a lesser portion of the abutment surfaces 36 and 38 may be covered with a friction material and still achieve the benefits of the invention.

The first and second elements 32 and 34 are variably linked by an appropriate mechanism. As illustrated, the linking mechanism comprises first and second parallel links 44 and 46 pivotally connected to element 32 by upper and lower pins 48 and 50, respectively. The links 44 and 46 are pivotally connected to element 34 by upper pin 52 and lower pin 54. As is the case with a commercial embodiment, the links 44,46 can be made from appropriate material, herein illustrated as aluminum plate for lightness. Further, the pins 48–54 forming the pivots may be formed from any one of a number of devices. It has been found that rivet assemblies give an economical and straight forward method of construction.

As illustrated, the parallel links 44 and 46 allow the elements 32 and 34 to move towards and away from one another while maintaining a parallel relationship between their abutment surfaces 36 and 38. The links 32 and 34 are biased towards a position wherein they accommodate a minimum door thickness by means of a spring 56 connected between the elements 32 and 34 by means of posts 58 and 60 respectively. It should be noted that in the position illustrated in FIG. 2 the spring 56 extends between the elements 32 and 34 so that it is at an acute angle relative to the direction of the parallel links 44 and 46 and preferably as close to a right angle as possible. This causes the links to pivot in such a way that the elements 32 and 34 are moved towards the minimum door thickness position.

On one of the elements, herein illustrated as element 34, a floor or ground engaging element 62 is pivotally mounted by means of a shaft 64 extending through a pair of webs 66 appropriately secured to the face 68 of element 34 that is opposite the abutment face of 38. The floor engaging element 62 has sufficient length so that when element 34 is at or near the bottom of the door 10, the element 62 will extend sufficiently to engage the ground 26 as in the illustration of FIG. 1 where a stoop 22 is arranged next to the door opening 12. In order to provide appropriate frictional engagement, a friction element 70 is positioned on the free end of floor or ground engaging element 62. As in the case with the other elements described in this invention, floor or ground engaging element 62 may be formed from any one of a number of materials. As illustrated, it is an aluminum tube and the friction element 70 is an appropriate diameter rubber cap used for tubular table legs.

Continuing to refer to FIG. 2, the adjustable door stop 30 is positioned on the door 10 by moving the elements 32 and 34 such that the links 44,46 swing in a clockwise direction so as to increase the space between the abutment surfaces 36 and 38. The elements 32 and 34 are then positioned on the end of the door 10 so that links 44 and 46 abut the outer edge 24 of the door 10. The elements 32 and 34 are released so that spring 56 can pull them together in such a way that the links 44 and 46 move in a counterclockwise direction and element 34 is at an elevational level higher than element 32. The floor or ground engaging element 62 is then swung downward in a clockwise direction so that it engages the surface 26 and is positioned approximately at a right angle to links 44,46. In this position, the portable door stop prevents movement of the door in the direction of arrow A or to the right as viewed in FIG. 2. It should be noted that the reaction force of moving the door 10 in direction A causes a force at the pivot 64 of floor engaging element 62 in a direction which causes the links 44 and 46 to move in a counterclockwise direction which further tightens elements 32 and 34 against the surface of the door. Therefore, as the rather substantial force of the commercial closing mechanism is applied to the portable door stop, it causes the door engaging elements 32 and 34 to engage the surface of the door even more tightly. It should also be noted that the elements 32 and 34 can be positioned up from the bottom of the door 10 so as to accommodate variable distances between the bottom of the door and the floor or ground 26. The arrangement of the portable door stop on the end of the door also provides an appropriate quick release. All that is necessary to release the door mechanism is to push it off the end of the door.

Up to now, the description covers a door which closes in the direction A. The portable door stop 32 has the ability to be used also on a door which closes in the direction B as shown in FIG. 3. In this figure the positions of elements 32 and 34 are reversed so that element 34 is on the left side of the door and element 32 is on the right side. It should also be noted that element 34 is again at an elevational level higher than element 32 but that movement of the parallel links 46 and 44 in a clockwise direction causes the elements 34 and 32 to move closer to one another. In this position, the floor or ground engaging element 62 is pivoted so that it extends in a direction approximately at a right angle to the parallel links 46 and 44. So that the spring 56 can be repositioned to be at an acute angle to parallel links 46 and 44 and preferably as close to a right angle as possible, it is connected to a second pair of posts 72 and 74 so that the spring 56 causes the links 46 and 44 to move in a clockwise direction. The benefits of self energizing and variable accommodations of ground or floor height are equal in this position. It also should be noted that the repositioning of the spring 56 is a relatively simple and straightforward matter allowing for rapid installation of the door stop in position on the end of the door.

Figure 4:
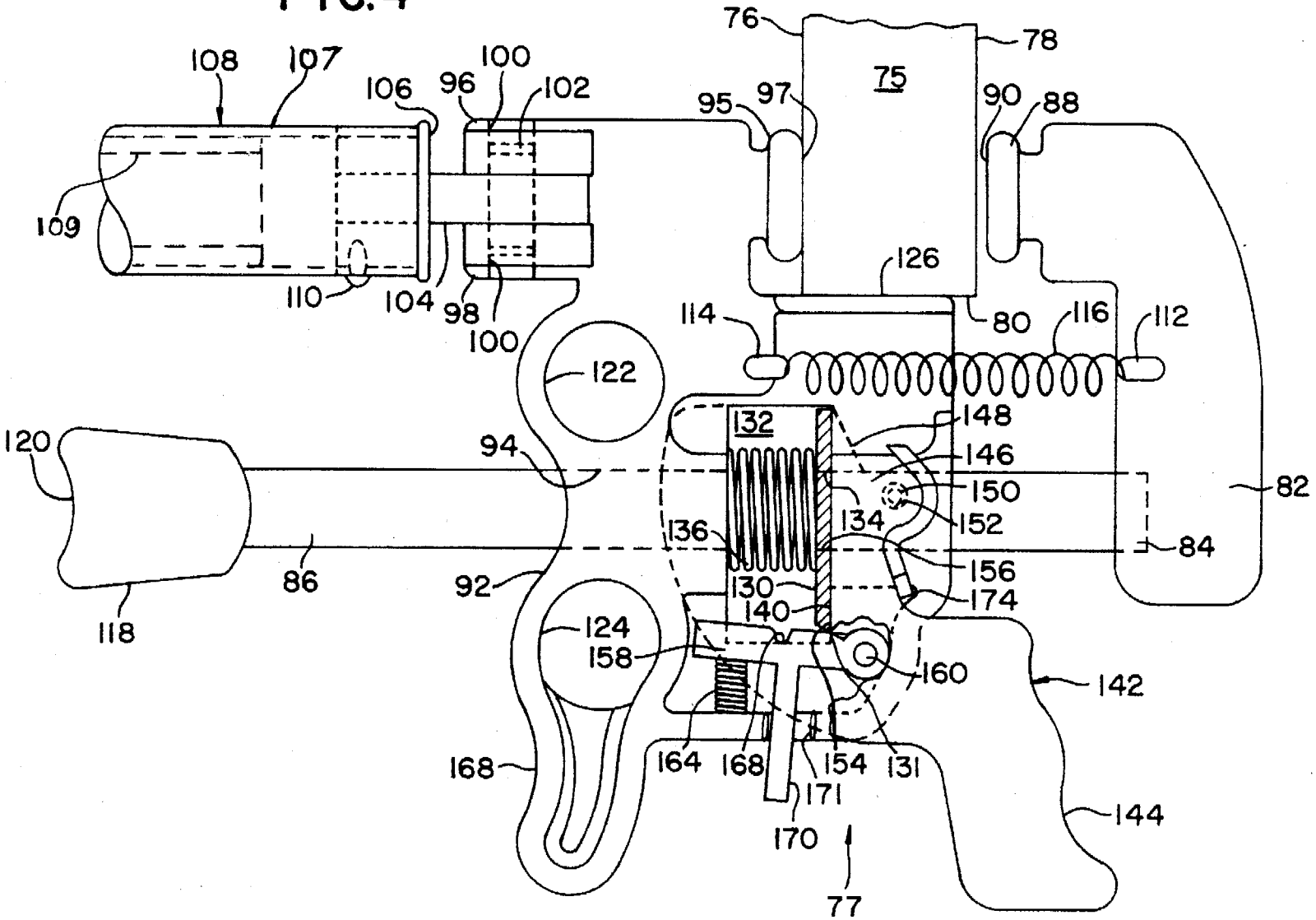
FIG. 4 is a side view of another embodiment of the present invention, showing initial installation on a door.
Figure 5:
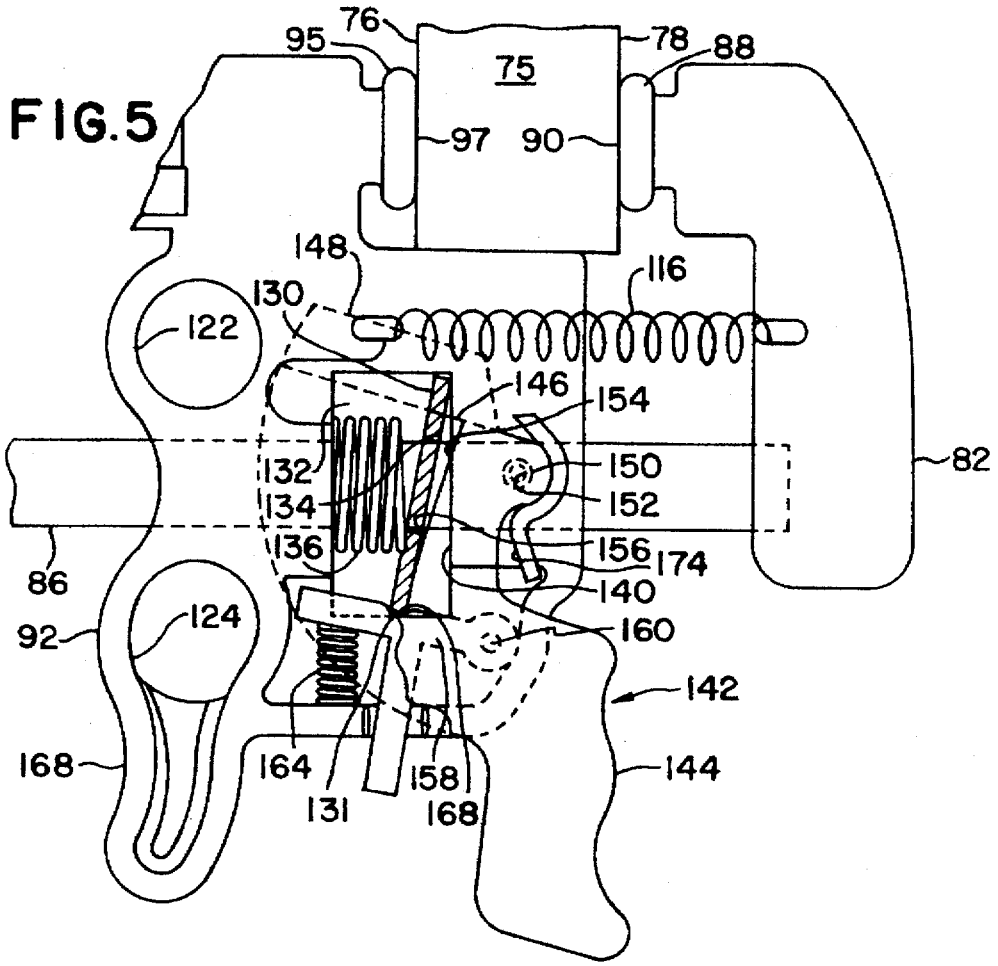
FIG. 5 is a side view of the door stop of FIG. 4, showing the door stop in clamping relation to a door; and, FIG. 6 is a fragmentary view of the door stop of FIG. 4, showing an alternative lock releasing mechanism.

FIGS. 4 and 5 show an alternate embodiment of the present invention positioned for installation on a door 75 having opposite faces 76, 78, and edge 80. The alternate door stop, generally indicated by reference character 77, comprises a first element 82 secured to one end 84 of an elongated member 86 in the form of a bar. Element 82 includes a pad 88 having a surface 90 opposing surface 78 of door 75. Although not shown for simplicity sake, an anti-friction surface, such as a rubber pad, is adapted to be placed over the surface 90. The bar 86 may be secured to the first element 82 by any suitable means. When element 82 is formed from molded plastic the plastic may be molded around the end 84 of bar 86.

A second element 92 has a central through slot 94 through which bar 86 slideably extends. Element 92 has a pad 95 and surface 97 positioned to be opposite surface 90 on pad 88. As with surface 90, anti-friction surfaces such as rubber may be provided over surface 97. Element 92 has a pair of posts 96 and 98 extending therefrom. Posts 98 and 96 have aligned bores 100 which receive a pin 102 forming a pivotal journal for a plate 104, integral with a cylindrical end cap 106 fitted into the end of a tubular floor engaging member 108. A suitable rivet 110 or other fastener holds the tubular member 108 in the end cap 106. Tubular member 108 may comprise an outer tube 107 into which an inner tube 109 is telescoped with a suitable locking mechanism (not shown) to accommodate differing distances to a floor or the ground.

Elements 82 and 92 have posts 112 and 114, respectively which receive ends of a spring 116 so that surfaces 90 and 97 are urged towards one another. The free end of bar 86 has a pad 118 with an arcuate recess 120 for receiving the thumb or other finger of an operator's hand. Element 92 has circular openings 122 and 124 for receiving other fingers of an operator's hand, so that the thumb may be used to press on arcuate recess 120 and to move pads 90 and 97 away from one another as shown in FIG. 4.

To install the portable door stop on the door 75, the surfaces 90 and 97 are positioned on opposite sides of the door 75 and the edge 80 of the door 74 is moved to abut an end pad 126 on element 92. The pressure on pad 118 is released to permit the spring 116 to pull the surfaces 90 and 97 into engagement with the door 75.

A one way drive mechanism is incorporated in element 92 to advance the surfaces 90 and 97 into clamping engagement with the opposite faces of the door 75. This clamping mechanism, generally indicated by reference character 128, comprises a driving plate 130 received in a cavity 132 in element 92. Driving plate 130 has a slot 134 through which bar 86 extends. A spring 136 is also received over bar 86 within cavity 132 and acts against the driving plate 130 to urge into engagement with a wall positioned substantially normal to the longitudinal axis of bar 86.

A trigger mechanism 142 comprises a hand engaging handle 144 connected to arcuate side wall 146 and 148. These side walls have pins 150 which extend into openings 152 in the side walls of element 92. Side walls 146 and 148 each contain end surfaces 154 which abut the section of driving plate 130 in a region below the bar 86. When the hand engaging handle 144 is pulled to the left as shown in FIG. 4, the surfaces 154 act against driving plate 130 to pivot it toward the position shown in FIG. 5 where the driving plate 130 is not normal to the longitudinal axis of bar 86. Further movement of the handle to the left, both in FIG. 4 and 5, causes the lower edge 156 of slot 134 to bind against the edge of bar 86 and move it towards the left in FIGS. 4 and 5 to bring surfaces 90 and 97 into a clamping engagement into the opposite faces 78 and 76, respectively, of door 75.

In order to hold the driving plate 130 in the clamping position, a locking plate 158 is pivotally mounted to element 92 by a pin 160. Pins on locking plate 158 and the lower wall of cavity 132 (both not shown) extend into the ends of a compression spring 164. Compression spring 164 urges locking plate 158 to pivot in a clockwise direction as shown in FIGS. 4 and 5. Locking plate 158 has a locking groove 168 positioned so that when the driving plate 130 is pivoted sufficiently from a position normal to the longitudinal axis of bar 86, its end 131 is received in locking groove 168, thus holding driving plate 130 in position so that surfaces 90 and 97 clamp the door 75. It should be noted element 92 has an extension 168 extending away from finger hole 124 to provide an opposing grip for handle 144.

In order to release the driving plate 130 from its non-normal position in FIG. 5, a post 170 extends downward from locking plate 158 through opening 171 in element 92. Movement of the post 170 by the thumb or other finger in the direction to the right as shown in FIG. 5 will pivot the locking plate 158 to a position permitting spring 136 to push driving plate 130 against wall 140 and thus permit movement of bar 86 relative to element 92. It should be noted that in the position illustrated in FIG. 4 where the actuating handle 142 is in a normal position, its movement in a counterclockwise direction is limited by a flange 174 to the position shown.

Figure 6:
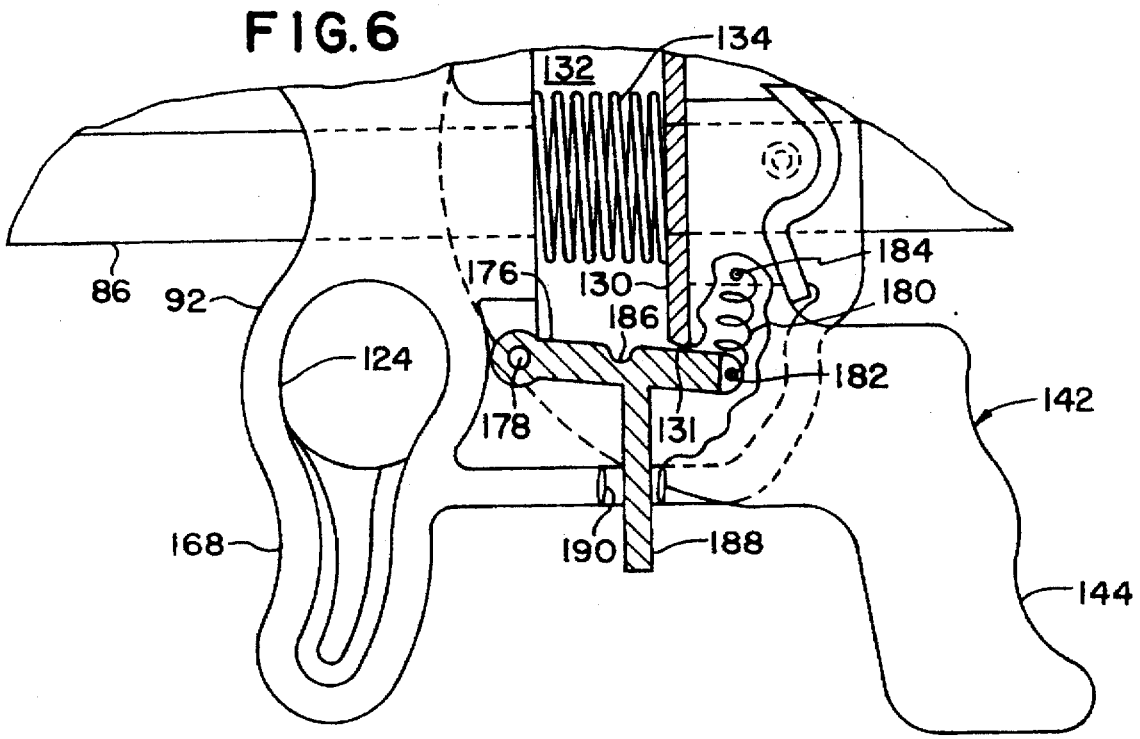

Refering to FIG. 6, an alternate locking plate 176 is shown which permits release by actuating a release trigger in the same direction as the actuating handle 142. In describing this figure, like number will be used for like numbered elements of the previous figures. Locking plate 176 is pivotally mounted to element 92 by means of a pin 178 positioned in cavity 132. Locking plate 176 is urged toward driving plate 130 by a tension spring 180 connected to the end 182 of locking plate 176 and to a post 184 on element 92. Locking plate 176 has a locking groove 186 positioned so that when the driving plate 130, is pivoted sufficiently from a position normal to the longitudinal axis of bar 86, its end 131 is received in locking groove 186, thus holding driving plate 130 in position. In order to release the driving plate from its non-normal and locked position, a post 188 extends downward from locking plate 176 through opening 190 in element 92. Movement of the post 188 to the left as shown in FIG. 6 pivots locking plate 176 in a clockwise direction, releasing the end 131 of locking plate, thus permitting locking plate 130 to be urged by spring 134 to a position normal to the longitudinal axis of bar 86. It should be noted that this version of the locking plate and associated mechanism allows release by using the same fingers that are used to actuate the hand engaging handle 144. This arrangement facilitates clamping and unclamping of the device.

Thus, when the portable door stop is intended to be used to hold a door open, the post 170 (or 188) is actuated so as to permit the driving plate 140 to be in the position illustrated in FIG. 4. In this position, the thumb, or other finger, is placed on pad 118 and fingers in holes 122 and 124 to displace the surfaces 90 and 97 sufficiently to embrace the side surfaces of the door 75 and that pad 126 is against the edge 80 of the door 75 at a height to provide sufficient leverage through floor engaging member 108.

The pad 118 is then released, allowing spring 116 to pull the surfaces 90 and 97 into engagement with the sidewalls 78 and 76 of the door 75. Then an operator's hand embraces extension 168 and the handle 144 to squeeze it, thus pivoting driving plate 130 in a clockwise direction as viewed in FIGS. 4 and 5 to pivot driving plate 130 to a position not normal to the longitudinal axis of the bar 86. Further movement of the handle 144 causes the edge 156 to bind against bar 86 bringing the surfaces 90 and 97 towards clamping engagement with door 75. When the driving plate has been pivoted sufficiently, its edge 131 is received in locking groove 168 and held in that position to maintain the clamping action on the door 75. The floor engaging tube 108 is pivoted to make an appropriate angle with the floor and extended into contact with it, thus holding the door 75 in the intended open position. It should be noted that a single actuation of the handle mechanism 142 is sufficient to bring the surfaces 90 and 97 into clamping engagement with the door 75 while the spring 116 allows rapid manipulation of the clamp to position the pads for variations in door thickness. At the same time, the post 170 (or 188) allows rapid disengagement of the portable door stop when it is no longer necessary to hold the door in an open position.

Both embodiments allow for rapid, efficient, and effective positioning of a portable door stop so as to maintain a door in an open position under widely varying circumstances. In addition, the embodiments shown in FIGS. 4, 5 and 6 act as a rapidly positionable clamp.

While preferred embodiments of the present invention have been described, it should be apparent to those skilled in the art that it may be practiced in forms other than specifically shown and still encompass the spirit and scope of the invention.

Having thus described the invention what is claimed is novel and desired to be secured by Letters Patent of the United States is:

1. A portable door stop comprising:

first and second elements having opposed surfaces for abutting the opposite faces of a door, means for variably linking said first and second elements to abut opposite faces of doors of different thicknesses and to maintain the abutting opposed surfaces of said first and second elements substantially parallel to one another, said variable linking means comprising an elongated member fixed to said first element and slideably extending through said second element such that the opposed surfaces on said first and second elements are guided for movement toward and away from one another, means on said second element for releasable one-way advancing of said elongated member to bring said opposed surfaces closer to one another for clamping them on the opposite faces of a door, said releasable one-way advancing means comprising a driving plate pivotally mounted to said second element and having an opening through which said elongated member extends, said opening being sized relative to said elongated member such that relative movement is permitted when said driving plate is in a position substantially normal to the longitudinal axis of said elongated member and when said driving plate is in a position not normal to the longitudinal axis of said elongated member at least one surface of said driving plate opening binds on the elongated member, means for displacing said driving plate from said normal position so that continued displacement of said driving plate displaces said elongated member relative to said second element in a direction to bring said opposed surfaces closer together, means for releasably locking said driving plate in the not-normal position whereby said door stop is releaseably secureable to the door, and a floor engaging leg mounted on one of said elements to prevent movement of said door.

2. A portable door stop as in claim 1 wherein:

said driving plate has one edge which swings through an arc as said plate is displaced from said substantially normal position to said not-normal position, said releasable locking means comprises a locking plate having a groove therein, said locking plate being pivotally mounted to said second element and positioned to pivot into engagement with said one edge of said driving plate and means for yieldably urging said locking plate into engagement with said one edge of said driving plate, so that said driving plate is held in said non-normal position.

3. A portable door stop as in claim 2 wherein said releasable one-way advancing means further comprises:

means for yieldably urging said driving plate to said substantially normal position, and means connected with said locking plate for pivoting it out of engagement with said driving plate, thereby permitting said driving plate to pivot into said substantially normal position and permit two way movement of said elongated member relative to said second element.

4. A portable door stop as in claim 3 wherein said locking plate pivoting means comprises a trigger extending at right angles to said locking plate for actuation by an operator to pivot said locking plate out of engagement with said driving plate.

5. A portable door stop as in claim 4 wherein said locking plate pivoting means comprises a pivot at one end of said locking plate and adjacent the driving plate when it is in its position normal to the longitudinal axis of said elongated member and said locking plate yieldable urging means comprises a compression spring connected to the other end of said locking plate and to the second element.

6. A portable door stop as in claim 4 wherein said locking plate pivoting means comprises a pivot at one end of said locking plate and spaced from the driving plate when it is in its position normal to the longitudinal axis of said elongated member and said locking plate yieldable urging means comprises a tension spring connected to the other end of said locking plate and to said second element.

7. A portable door stop as in claim 1 wherein said driving plate displacing means comprises a hand engaging element pivotally mounted to said second element adjacent said driving plate and having a surface abuttable with said driving plate for displacing it from a nod-normal position.

8. A portable door stop as in claim 7 wherein said second element further comprises an extension positioned to be adjacent said hand engaging element to permit grasping of the extension and the hand engaging element with the same hand.

9. A clamping device comprising:

first and second elements having opposed surfaces for abutting opposite faces of a workpiece, an elongated member fixed to said first element and slideably extending through said second element such that the opposed surfaces are guided for movement toward and away from one another, means for yieldably biasing said first and second elements toward one another to abut workpieces having different thickness, and means on said second element for releasable one-way advancing of said elongated member to bring said opposed surfaces closer to one another for clamping them on the opposite face of the workplace.

10. A clamping device as in claim 9 wherein said releasable one-way advancing means comprises:

a driving plate pivotally mounted to said second element and having an opening through which said elongated member extends, said opening being sized relative to said elongated member such that relative movement is permitted when said driving plate is substantially normal to the longitudinal axis of said elongated member and when said driving plate is not normal at least one surface of said driving plate opening binds on the elongated member means for displacing said driving plate from said normal position so that continued displacement of said driving plate displaces said elongated member relative to said second element in a direction to bring said opposed surfaces closer together, and means for releasable locking said driving plate in the non-normal position whereby said clamping device is releasable from said workpiece.

11. A clamping device as in claim 10 wherein:

said driving plate has one edge which swings through an arc as said plate is displaced from said substantially normal position to said non-normal position, said releasable locking means comprises:

a locking plate having a groove therein, said locking plate being pivotally mounted to said second element and positioned to pivot into engagement with said one edge of said driving plate, means for yieldably urging said locking plate into engagement with said one edge of said driving plate, so that said driving plate is held in said non-normal position, means for releasably urging said driving plate to aid substantially normal position, and means connected with said locking plate for pivoting it out of engagement with said driving plate, thereby permitting said driving plate to pivot into said substantially normal position and permit two way movement of said elongated member relative to said second element.

* * * * *